United States Patent [19]

Stemmer et al.

[11] Patent Number: 4,528,795

[45] Date of Patent: Jul. 16, 1985

[54] DEVICE FOR MANUALLY INSERTING A SLIDE INTO A SLIDE FRAME

[75] Inventors: Gottfried Stemmer, Garmisch-Partenkirchen; Claus Pohl, Eschenlohe, both of Fed. Rep. of Germany

[73] Assignee: Geimuplast Peter Mundt GmbH & Co KG, Farchant, Fed. Rep. of Germany

[21] Appl. No.: 510,185

[22] Filed: Jul. 1, 1983

[30] Foreign Application Priority Data

Jul. 7, 1982 [DE] Fed. Rep. of Germany ... 8219474[U]
May 17, 1983 [DE] Fed. Rep. of Germany ..... 3317960

[51] Int. Cl.[3] ..... B65B 5/04

[52] U.S. Cl. ..... 53/266 R; 53/390; 53/520; 29/270; 29/281.1

[58] Field of Search ..... 53/520, 266 C, 266 R, 53/390, 381 R; 29/270, 281.1

[56] References Cited

U.S. PATENT DOCUMENTS

| | | | |
|---|---|---|---|
| 3,470,642 | 10/1969 | Mundt et al. | 53/266 C X |
| 3,614,854 | 10/1971 | Mundt et al. . | |
| 3,788,031 | 1/1974 | Florjancic | 53/520 |
| 4,004,340 | 1/1977 | Urban | 53/266 C X |
| 4,102,029 | 7/1978 | Thompson | 53/520 X |

*Primary Examiner*—Frederick R. Schmidt
*Assistant Examiner*—Steven P. Schad
*Attorney, Agent, or Firm*—Fleit, Jacobson, Cohn & Price

[57] ABSTRACT

This invention relates to a device for expanding the entrance slot of a plastic slide frame having at least one resiliently expandable entrance slot, which device comprises two noses, which are arranged to engage the top surfaces of frame edge portions disposed laterally of the entrance path for the slide, and a ramp, which is spaced from said noses. In order to permit such a device to be operated without a need for a special protection against fingerprints, the device comprises a feeding pusher for pushing the slide through the expanded entrance slot.

11 Claims, 8 Drawing Figures

DEVICE FOR MANUALLY INSERTING A SLIDE INTO A SLIDE FRAME

This invention relates to a device for expanding the entrance slot of a plastic slide frame having at least one resiliently expandable entrance slot, which device comprises two noses, which are arranged to engage the top surfaces of frame edge portions disposed laterally of the entrance path for the slide, and a ramp, which is spaced from said noses.

German Patent Specification No. 12 95 877 discloses such a device, which has an opening, which corresponds approximately to the picture aperture of the frame and through which the slide can be grasped with the fingers. In this way the object is accomplished to provide the buyer of the slide frame with a device for manually expanding the entrance slot for the slide so that he can mount the slide in the slide frame by hand or can replace slides of frames which have been loaded by machine. That end of the slide frame at which the entrance slot is provided is so inserted into the device that the two noses engage the top surfaces of those frame edge portions which are laterally disposed with respect to the entrance path for the slide. The underside of the frame is placed on the ramp, which is spaced apart from the noses. Thereafter the rear portion of the frame is depressed toward the device so that the entrance slot for the slide is expanded between the top and base parts of the frame and the slide which has previously been inserted in part into the expanded entrance slot can be grasped through the opening and can be entirely inserted into the frame.

To ensure that no fingerprints would be left on the image area of the slide, the hand used to insert the slide into the frame had to be covered with a soft glove.

It is an object of the invention so to improve the known device that there is no need for special means for preventing fingerprints.

This object is accomplished in that the device comprises a feeding pusher for pushing the slide through the expanded entrance slot. In such a device the slide is pushed into the frame by a pusher, which is incorporated in the device.

A further object is to improve a device of the kind described first hereinbefore so that it can be operated in a simpler manner.

This object is accomplished in that the device comprises two laterally disposed guide rails, which extend in the direction in which the slide is to be inserted and engage the top of the protruding edge portion of the lower part of the frame and define a guide passage, which is downwardly inclined in its rear portion. The advantage afforded by that device resides in that it can be held in position on a support by one hand and the frame which has been placed into the device will automatically remain in the position in which the entrance slot has been expanded. As a result, the insertion of the slide into the frame and into the pusher and the pushing of the pushing slider and the slide placed into said pusher into the frame will be facilitated.

In a preferred embodiment of the invention, a wedge is provided at the end of at least one guide passage and protrudes into said guide passage. This embodiment affords the further advantage that the wedges bend the cover upwardly so that the entrance slot can be further expanded.

Two illustrative embodiments of the invention will now be described with reference to the drawing, in which.

Figure 1:
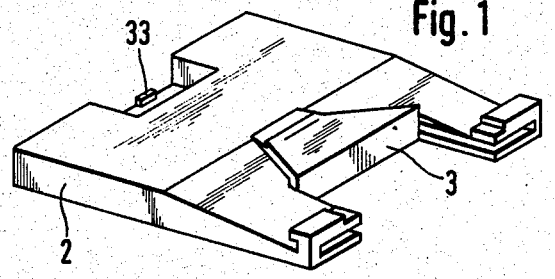
FIG. 1 shows a first embodiment of the device according to the invention in a locked position.

In the drawing, the slide is designated 1 and the device is designated 2. The latter is generally similar to that shown in German Patent Specification No. 12 95 877 but is closed also at its top by a top wall, as is shown in FIG. 1. The feeding pusher 3 shown in all figures of the drawing is provided with a feeding nose 31 and under the latter with a limiting stop 32 at that end of the pusher which is opposite to the leading end. At said leading end, the feeding pusher 3 has an additional limiting stop 33, which is shown in FIG. 1 and cooperates with the surrounding U-shaped recess, which is shown in FIG. 1. The stop 33 serves to define the extracted or initial position of the pusher 3.

Figure 4:
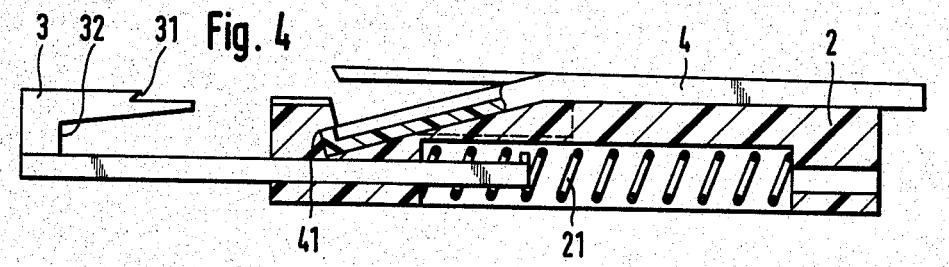
FIG. 4 is a longitudinal sectional view showing the device of FIG. 3 without a slide.
Figure 5:
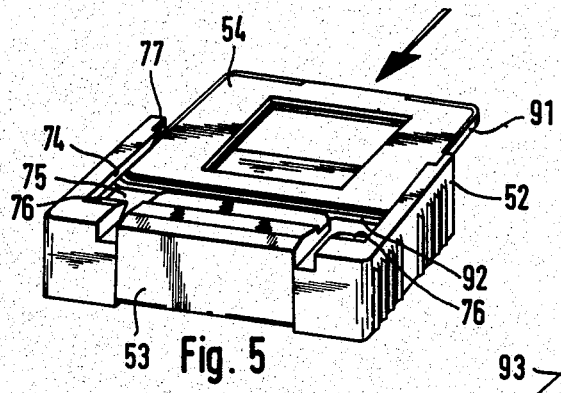
FIG. 5 shows a different, more desirable embodiment of the device during the insertion of the slide frame.

In the manner which is best apparent from FIG. 4, the slide frame 4 is inserted into the device 2 so that the edge 41 of the lower part of the slide frame 4 is disposed below the noses of the device 2. By means of the inclined ramp of the device 1, which ramp is shown in FIG. 1, the entrance slot of the slide frame is thus expanded as shown in FIG. 4, in the manner known from German Patent Specification No. 12 95 877.

Figure 2:
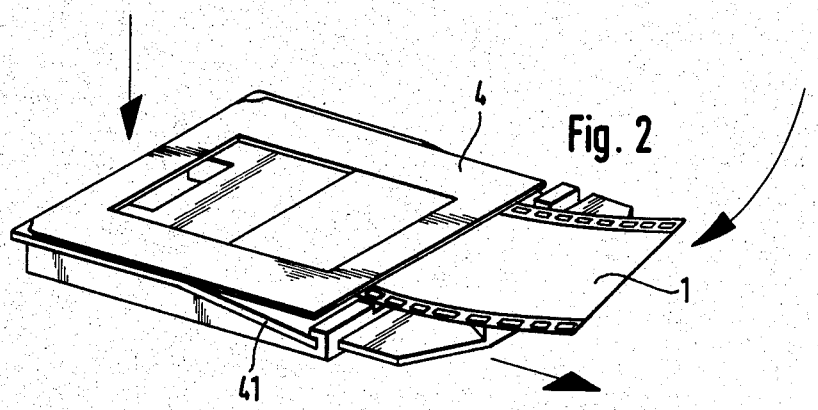
FIG. 2 shows the same device with a slide which has been inserted only in part.
Figure 3:
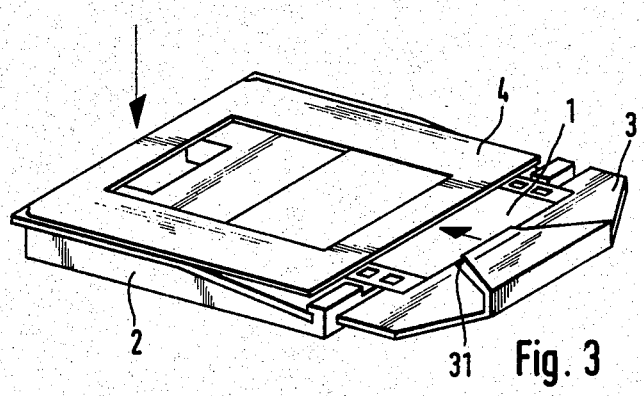
FIG. 3 shows the same embodiment in the position in which the feeding pusher engages the slide.

Thereafter the cut-off slide 1 is grasped with the hand at its edges or at the perforations and is partly introduced into the entrance slot of the slide frame 4, as is shown in FIG. 2. The slide 1 is pushed into the entrance slot of the slide frame 4 until the slide is disposed in front of the feeding nose 31 of the pusher 3, as is shown in FIG. 3.

The pusher 3 is then forced into the device 2 toward the slide frame 4 so that the wedge-shaped nose 31 of the pusher 3 engages the slide 1 and pushes the latter entirely into the slide frame 4 until the slide 1 is held in the frame 4 in a position for projection. That position has been reached when the feeding pusher 3 has been inserted to such an extent that the limiting stop 32 of the feeding nose 31 engages the edge 41 of the frame. The distance from the wedge 31 of the feeding nose to the limiting stop 32 of the pusher 3 is so selected that the slide 1 will be properly positioned in the frame 4 when the pusher 3 has been entirely inserted.

Thereafter the pusher 3 can be pulled out of the device 2 so that the feeding nose 31 with its wedge is moved out of the entrance slot of the slide frame 4 while the slide 1 remains in the position in which it can be projected.

In a preferred embodiment the device 2 comprises a compression spring 21, which is shown in FIG. 4 and after the insertion of the slide automatically returns the pusher 3 to its initial position, which is defined by the stop 33.

According to a further proposal, the device 2 and the pusher 3 are provided with cooperating detent elements, which are known per se and not apparent from the drawing. These detent elements resiliently lock the pusher 3 in its pushed-in position in the device 2 when no frame 4 has been inserted into the device. In that position the area of the device does not exceed the area of a frame (50×50 mm) so that the device can be included in a conventional frame package.

Another desirable embodiment is shown in FIGS. 5 to 8, in which the slide is designated 51, the entire device is designated 52 and the feeding pusher is designated 53. The slide frame 54 comprises a base frame 91 having a surrounding edge portion 92, and a top frame 93, which is held in the edge portion 92. The device 52 comprises two laterally disposed guide rails 74, which extend in the direction in which the slide frame 54 is to be inserted and engage the top of the two mutually opposite side edges 92 of the frame. In the device 52, the slide frame 54 is supported by a surface which is downwardly inclined in its rear portion, which faces the feeding slider 53 when it has been inserted by the device. The guide passages for guiding the slide frame 54 between the guide rails 74 and the surface for supporting the slide frame 54 are downwardly inclined in said rear portion. The guide rails 74 are provided with forward beveled receiving surfaces 77, which facilitate the insertion of the slide frame 54 under the guide rails 74.

The guide rails 74 overlap only the base frame 91 but do not overlap the top frame 93.

When the base frame 91 has been inserted under the guide rails 74, it can be inserted further into the downwardly inclined guide passage and by the latter is downwardly deformed in such a manner that an entrance slot 94 is opened up between the top frame 93 and the base frame 91. As the insertion of the slide frame 54 is continued, the two wedges 76 disposed in the device on the left and right of the feeding pusher 53 enter the entrance slot 94 and lift the top frame 93 so that the entrance slot 54 is expanded further.

Figure 7:
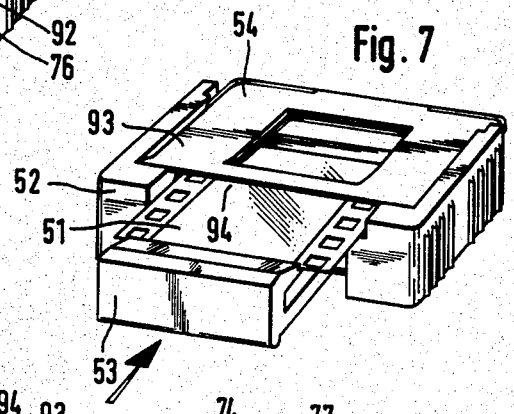
FIG. 7 shows the device of FIGS. 5 and 6 at the time when the pusher engages the slide.
Figure 6:
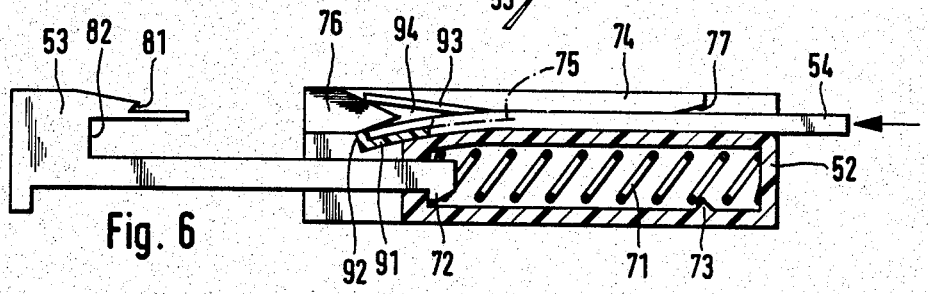
FIG. 6 is a sectional view showing the device of FIG. 5.
Figure 8:
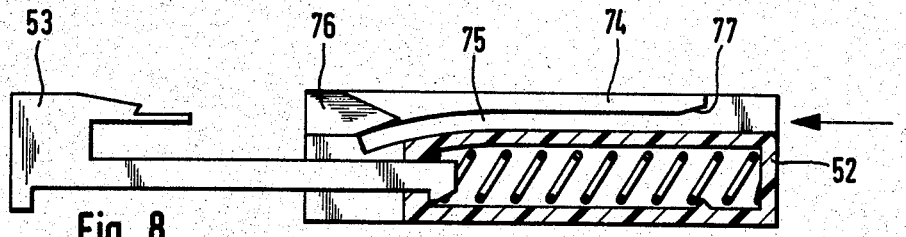
FIG. 8 is a sectional view showing the device of FIGS. 5 to 7 without a slide frame.

The cut-off slide 51 is grasped with the hand at its edges or at the perforations and is partly introduced into the entrance slot of the slide frame 54, as is shown in FIG. 7. The slide 51 is inserted into the entrance slot of the slide frame 54 until the slide is disposed in front of the feeding nose 81 of the pusher 53, as is shown in FIG. 6. The pusher 53 is then forced into the device 52 toward the slide frame 54 so that the wedge-shaped nose 81 of the pusher 53 engages the slide 51 and feeds the latter entirely into the slide frame 54 until the slide 51 is held in the frame 54 in a position for projection. That position has been reached when the feeding pusher 53 has been inserted to such an extent that the limiting stop 82 of the feeding pusher 53, which limiting stop is shown in FIG. 6, engages the edge portion 92 of the frame. The distance from the wedge of the feeding noise 81 to the limiting stop 82 of the pusher 53 is such that the slide 51 is properly positioned in the frame 54 when the pusher 53 has been entirely inserted.

Thereafter the pusher 53 can be pulled out of the device 52 so that the feeding nose 81 with its wedge is moved out of the entrance slot of the slide frame 54 while the slide 51 remains in the position in which it can be projected. But the pusher 53 need not be pulled out of the entrance slot of the slide frame after the mounting of each slide. When the slide has been entirely inserted into the slide frame, the limiting stop 82 may be used to push the frame out of the device to some extent in the direction of the guide passage so that the frame can be removed more easily. That additional displacement will cause the pusher to be resiliently locked to the device. The pusher will remain in its locked position when the slide frame containing the mounted slide is removed from the device. The pusher will not be released until a new frame is inserted into the device. This resilient locking action facilitates the operation of the device because the pusher is held in its initial position.

It is apparent from FIG. 6 that a compression spring 71 may be provided to urge the feeding pusher 53 to the position in which the slide 51 can be inserted. FIG. 6 also shows detent noses 72, 73, which are respectively provided on one end of the feeding pusher 53 and on the device. By means of the detent noses 72, 73, the feeding pusher is held in its initial position before the slide frame is inserted into the device. As the slide frame 54 is inserted, the feeding pusher is automatically released in that the edge portion 92 of the frame depresses the pusher 53.

What is claimed is:

1. A device for holding a slide frame and manually inserting a slide into the slide frame, said device comprising: expanding means for expanding an entrance slot of a plastic slide frame having at least one resiliently expandable entrance slot defined by slide frame upper and lower surfaces, said expanding means including two laterally spaced holding noses which are arranged to engage upstanding edges of the slide frame lower surface and are disposed laterally of an entrance path for the slide into the slide frame, and including ramp means spaced from said holding noses and against which the lower surface of the slide frame rests, feeding pusher means carried by and manually movable into and out of the device for pushing the slide through the expanded entrance slot into the slide frame, the pusher means including a feeding nose for engaging an edge of the slide, and an opening in a side of the device adjacent to the slide frame entrance slot for receiving the feeding pusher means, the opening positioned below the entrance slot of the slide frame held by the device and including a wedge-shaped recess for receiving the feeding nose of the feeding pusher means, the feeding pusher means including a first limiting stop positioned below the feeding nose to limit the extent of inward movement of the pusher means into the device.

2. A device according to claim 1, wherein the feeding pusher means includes a second limiting stop at an end thereof opposite to and spaced from the first limiting stop to limit the maximum outward movement of the pusher means relative to the device.

3. A device according to claim 2, including two laterally disposed guide rails to define opposed guide passages that extend in the direction which the slide is to inserted and wherein the guide rails engage edge portions of the lower surface of the slide frame, said opposed guide passages being downwardly inclined relative to the upper surface of the slide frame at the innermost portions of said passages.

4. A device according to claim 3, wherein a wedge is provided at an innermost end of at least one of said guide passages and protrudes into said guide passage to enter and expand the entrance slot of the slide frame by separating the upper and lower surfaces at the entrance slot when a slide frame is inserted into the device.

5. A device according to claim 4, wherein said feeding nose includes a wedge-shaped portion for engaging an edge of the slide.

6. A device according to claim 5, wherein a compression spring is provided to urge the feeding pusher means into an outward direction relative to the device.

7. A device according to claim 6, including detent means for holding the feeding pusher means so that it does not extend beyond the side of the device when the device is in a packaged position.

8. A device according to claim 1, including detent means for holding the feeding pusher means so that it does not extend beyond the side of the device when the device is in a packaged position.

9. A device according to claim 1, wherein a compression spring is provided to urge the feeding pusher means into an outward direction relative to the device.

10. A device according to claim 1, including two laterally disposed guide rails to define opposed guide passages that extend in the direction in which the slide is to be inserted and wherein the guide rails engage edge portions of the lower surface of the slide frame, said opposed guide passages being downwardly inclined relative to the upper surface of the slide frame at the innermost portions of said passages.

11. A device according to claim 10, wherein a wedge is provided at an innermost end of at least one of said guide passages and protrudes into said guide passage to enter and expand the entrance slot of the slide frame by separating the upper and lower surfaces at the entrance slot when a slide frame is inserted into the device.

* * * * *